US007384521B2

(12) United States Patent
Wang et al.

(10) Patent No.: US 7,384,521 B2
(45) Date of Patent: Jun. 10, 2008

(54) METHOD FOR REDUCING CELL VOLTAGE AND INCREASING CELL STABILITY BY IN-SITU FORMATION OF SLOTS IN A SODERBERG ANODE

(75) Inventors: Xiangwen Wang, Export, PA (US); Alton T. Tabereaux, Muscle Shoals, AL (US); Jerry L. Roddy, Knoxville, TN (US); Alain J. Belda, New York, NY (US)

(73) Assignee: Alcoa Inc., Pittsburgh, PA (US)

( * ) Notice: Subject to any disclaimer, the term of this patent is extended or adjusted under 35 U.S.C. 154(b) by 329 days.

(21) Appl. No.: 11/215,586

(22) Filed: Aug. 30, 2005

(65) Prior Publication Data

US 2007/0045104 A1 Mar. 1, 2007

(51) Int. Cl.
*C25B 11/12* (2006.01)

(52) U.S. Cl. ..... 204/294; 204/243.1; 204/247; 204/288; 204/289

(58) Field of Classification Search ..... 204/294, 204/243.1, 247, 288, 289; 205/375, 380
See application file for complete search history.

(56) References Cited

U.S. PATENT DOCUMENTS

| | | | | |
|---|---|---|---|---|
| 1,440,724 | A | 1/1923 | Soderberg | |
| 2,480,474 | A | 8/1949 | Johnson | 204/67 |
| 2,917,441 | A | 12/1959 | Donald | 204/67 |
| 2,958,641 | A | 11/1960 | Reynolds | 204/286 |
| 3,756,929 | A | 9/1973 | Schmidt-Hatting et al. | 204/67 |
| 3,996,117 | A | 12/1976 | Graham et al. | 204/67 |
| 4,342,637 | A | 8/1982 | Withers et al. | 204/282 |
| 4,602,990 | A | 7/1986 | Boxall et al. | 204/243 |
| 5,030,335 | A | 7/1991 | Olsen | 204/243 |
| 5,380,416 | A * | 1/1995 | McMinn | 204/245 |
| 5,746,906 | A * | 5/1998 | McHenry et al. | 208/22 |

OTHER PUBLICATIONS

*How to Obtain Open Feeder Holes by Installing Anodes with Tracks,* Bjor Petter Moxnes, Bjorn Erik Aga and Jorn Hembre Skaar, Hydro Aluminum A.S., Technology Center Ardel, Light Metals 1998, The Minerals, Metals and Materials Society 1998, pp. 247-255.

*Aluminum and Its Production,* Junius David Edwards, Francis C. Frary and Zay Jeffries, Aluminum Company of America, McGraw-Hill Book Company, Inc., New York, 1930 pp. 300-307.

Pending U.S. Appl. No. 10/799,036, filed Mar. 11, 1904, Barclay et al.

International Search Report and Written Opinion for PCT Application No. PCT/US2006/033797, which claims priority to U.S. Application No. 11/215,586 Jun. 18, 2007.

* cited by examiner

*Primary Examiner*—Bruce F Bell
(74) *Attorney, Agent, or Firm*—Greenberg Traurig, LLP

(57) ABSTRACT

A self-baking, Soderberg type carbon anode (40) for use in an aluminum electrolyses cell (1) to form product aluminum (11), where the anode (40) is consumable in molten electrolyte (12) in the cell, the anode having top, bottom and side surfaces and at least four layers of vertically disposed plate inserts (48) meltable in the molten electrolyte, the plate inserts (48) preferably made of aluminum and are capable of melting to create hollow vertical slots (52) at the bottom of the anode facilitating any gas bubbles (60) generated to channel to the side of the anode into the electrolyte (12).

14 Claims, 5 Drawing Sheets

METHOD FOR REDUCING CELL VOLTAGE AND INCREASING CELL STABILITY BY IN-SITU FORMATION OF SLOTS IN A SODERBERG ANODE

FIELD OF THE INVENTION

The present invention relates to use of vertical slots in self baking carbon anodes for use in aluminum electrolysis cells, where the slots channel anode gas from the anode surfaces.

BACKGROUND OF THE INVENTION

Aluminum is produced conventionally by the electrolysis of alumina dissolved in cryolite-based (usually as NaF plus $AlF_3$) molten electrolytes at temperatures between about 900° C. and 1000° C.; the process is known as the Hall-Heroult process. A Hall-Heroult reduction cell/"pot" typically comprises a steel shell having an insulating lining of refractory material, which in turn has a lining of carbon that contacts the molten constituents. Conductor bars connected to the negative pole of a direct current source are embedded in the carbon cathode substrate that forms the cell bottom floor. In general carbon anodes are consumed with evolution of carbon oxide gas ($CO_2$ and CO), as gas bubbles and the like.

The consumption of carbon anodes in molten electrolyte is shown in U.S. Pat. Nos. 2,480,474 and 3,756,929 (Johnson FIG. 6*a* and Schmidt-Hatting et al. FIG. 1, respectively). Anodes are at least partially submerged in the bath and those anodes as well as their support structures are replaced regularly once the carbon is consumed. Alumina is fed into the bath during cell operation and it is important to have good alumina dissolution. The anode gas bubbles will help to create/cause bath flow and turbulence. It is important to create a good turbulence by anode gas bubbles to the extent favorable to increase alumina dissolution.

Traditional technology relied on natural flow of gases from under the carbon anodes during the aluminum reduction process, but this delayed gas bubble removal and decreases efficiencies and aluminum production. This presence and build up of gas generated during electrolysis has been a continuing problem in the industry and a cause of high energy requirements, and to efficiently operate the electrolysis cells, the electrodes must be properly designed.

As used to produce aluminum by the Hall-Heroult electrolytic process, there are two anode technologies. One is a pre-baked anode characterized by U.S. Pat. No. 2,480,474, mentioned previously, and U.S. Ser. No. 10/799,036, filed on Mar. 11, 2004 (Barclay et al.) The other is a "Soderberg" self-baking anode cell technology characterized by U.S. Pat. No. 3,996,117 (Graham et al.). In a pre-baked cell, there are usually 10 up to 40 anodes depending on cell size (amperage). Soderberg cells have only one large self-baking anode of approximate size, 2-3 meters wide and 5-6 meters in length. This self-baking is taught by Soderberg in U.S. Pat. No. 1,440,724.

As described by Edwards et al. in *Aluminum and Its Production*, MCGraw-Hill, New York, 1930, pp. 300-307, carbon anodes can be made of a mixture of carbon, pitch and tar which is pressed into molds and subsequently baked in a baking oven, or they can be made by the Soderberg technique.

In the Soderberg technique, a steel casing is used to hold carbonaceous material of electrode paste of carbon and tar-pitch. The electrode mix at the bottom end, for example in a cryolite bath, is gradually baked to provide a dense, baked carbon electrode of good conductivity, and then consumed in the cryolite by electrolysis.

As for pre-baked anodes, the use of single and multiple bottom anode slots, across the entire anode bottom, to improve gas release in aluminum processing has been reported in *Light Metals*, "How to Obtain Open Feeder Holes by Installing Anodes with Tracks", B. P. Moxnes et al., Edited by B. Welch, The Minerals, Metals & Materials Society, 1998, pp. 247-255. There, 1.4 meter anodes were tested.

As shown by previously mentioned Barclay et al. U.S. Ser. No. 10/799,036 inward non-continuous slots in the bottom of a pre-baked anode can facilitate gas bubble movement and reduce energy consumption. U.S. Pat. No. 4,602,990 (Boxall et al.) taught bottom sloped either pre-baked or Soderberg anodes conforming to a sloped cathode design to either enhance or inhibit gas bubble motion However, the sloped anode can only be coupled with sloped cathodes and it cannot be used in a flat bottom cathode cell.

With their large bottom surface area Soderberg anodes can present serious problems in gas evolution. In U.S. Pat. No. 3,996,117 (Graham et al.). A carbon block anode disposed between a steel jacket provided for the upper sides of the anode is illustrated as well as anode gas, primarily $CO_2$ bubbles, which are substantially trapped below an alumna containing crust.

In U.S. Pat. No. 5,030,335 (Olsen), the trapped $CO_2$ gas was recognized as a problem during the passing of the $CO_2$ gas to a disposal burner, since the gas would also contain pitch volatiles and the combustion product would have to be wet or dry cleaned. Also, breaks in the crust would allow gas escape in the furnace building. In this patent, a plurality of liftable cover plates was used as seals. In this patent, the side steel jacket/manifold for the Soderberg anode is more clearly shown. None of the previous two Soderberg cell designs solves problems of $CO_2$ gas formation of the bottom of the anode.

In a self-baking Soderberg electrolysis cell, during electrolysis, a large quantity of anode gas (40 to 50 kg $CO_2$/hour) is produced on the single anode bottom surface, and the anode gas has to travel a considerable distance before it can be released from the bottom surface of the anode. The gas bubbles coalesce and grow even larger before they escape from large anode bottom surface. This process of the anode gas bubble formation, coalescence, and release/escape from anode surface creates significant cell instability, and therefore, Soderberg cells usually have a lower current efficiency than pre-baked cells. At the same time, the anode gas bubbles cover a large percentage of the bottom anode surface and that results in a significant increase in electrical resistance and cell voltage, resulting in a higher energy consumption than pre-baked cell technologies.

What is needed is a Soderberg carbon anode design that will quickly channel anode gas out of the bottom horizontal surface to improve cell current efficiency, increase cell stability and reduce electrical resistance.

It is a main object of this invention to provide a cell design to reduce the amount of gas bubbles at the bottom surface of self-baking Soderberg anodes.

SUMMARY OF THE INVENTION

The above needs are met and object accomplished by providing, in an aluminum electrolysis cell, a consumable self-baking Soderberg type carbon anode consumable in molten electrolyte, having top, bottom and side surfaces, with electrically conducting vertical metal pins disposed within the anode body, operating in molten electrolyte in an aluminum electrolysis cell, where gas bubbles are generated at the anode bottom surface, wherein the carbon anode is moveable in a vertical downward direction into the molten electrolyte as the carbon anodes is consumed, wherein the carbon anode has at least four outward vertical slots at the bottom of the anode surface along a horizontal axis of the carbon anode, where the slots are exposed to the molten electrolyte allowing gas bubbles generated to pass into the electrolyte and away from the anode without plugging the slot; the anode also containing at least four layers or rows of vertically disposed plate inserts selected from the group consisting of aluminum, aluminum oxide, cryolite and mixtures thereof, within the anode, where a bottom layer of inserts will melt/dissolve with downward movement of the anode into the molten electrolyte, to form new outward vertical slots at the bottom of the anode upon contact with the electrolyte.

The initial slots and the inserts will be 6 cm to 50 cm high and 0.75 cm to 1.5 cm wide and 50 cm to 120 cm long. The molten electrolyte will be cryolite, based on $Na_3$ $AlF_6$, having an operating temperature, usually, of from about 900° C. to about 1000° C.

The non-continuous slots are formed in the carbon anodes in such a manner as to direct flow of bubbles and coalesced bubbles generated on the anode surfaces into the slots to facilitate the gas bubbles rapidly moving out of the anode bottom surface to the sideline of the reduction cell.

The invention also resides in a self-baking Soderberg type carbon anode consumable in molten electrolyte, having top, bottom and side surfaces, wherein the carbon anode has at least four layers of vertically disposed plate inserts selected from the group consisting of aluminum, aluminum oxide, cryolite and mixtures thereof, meltable in molten cryolite electrolyte, said inserts capable of melting to create an outward hollow vertical slots at the bottom of the anode, allowing any gas generated upon operation of the anode to pass through the slots to the side of the anode.

This invention relates to forming vertical slots in the Soderberg anode surface by vertically inserting aluminum plates from top of the anode during charging carbon paste. The number of slots and configurations of slots are so designed that they can effectively and efficiently break the large gas bubble formation and channel the anode gas out of anode surface quickly. By doing so, the cell current efficiency can be improved by increasing the cell stability. Also, reducing the amount of gas bubbles at the bottom surface of Soderberg anodes will significantly reduce the electrical resistance, lower the total cell voltage, and thereby reduce the cell electrical energy consumption. Preferably, the plate inserts will be aluminum or low impurity aluminum alloy.

BRIEF DESCRIPTION OF THE DRAWINGS

A full understanding of the invention can be appreciated from the following Detailed Description of the Invention when read with reference to the accompanying drawings wherein.

DETAILED DESCRIPTION OF THE INVENTION

Figure 1:
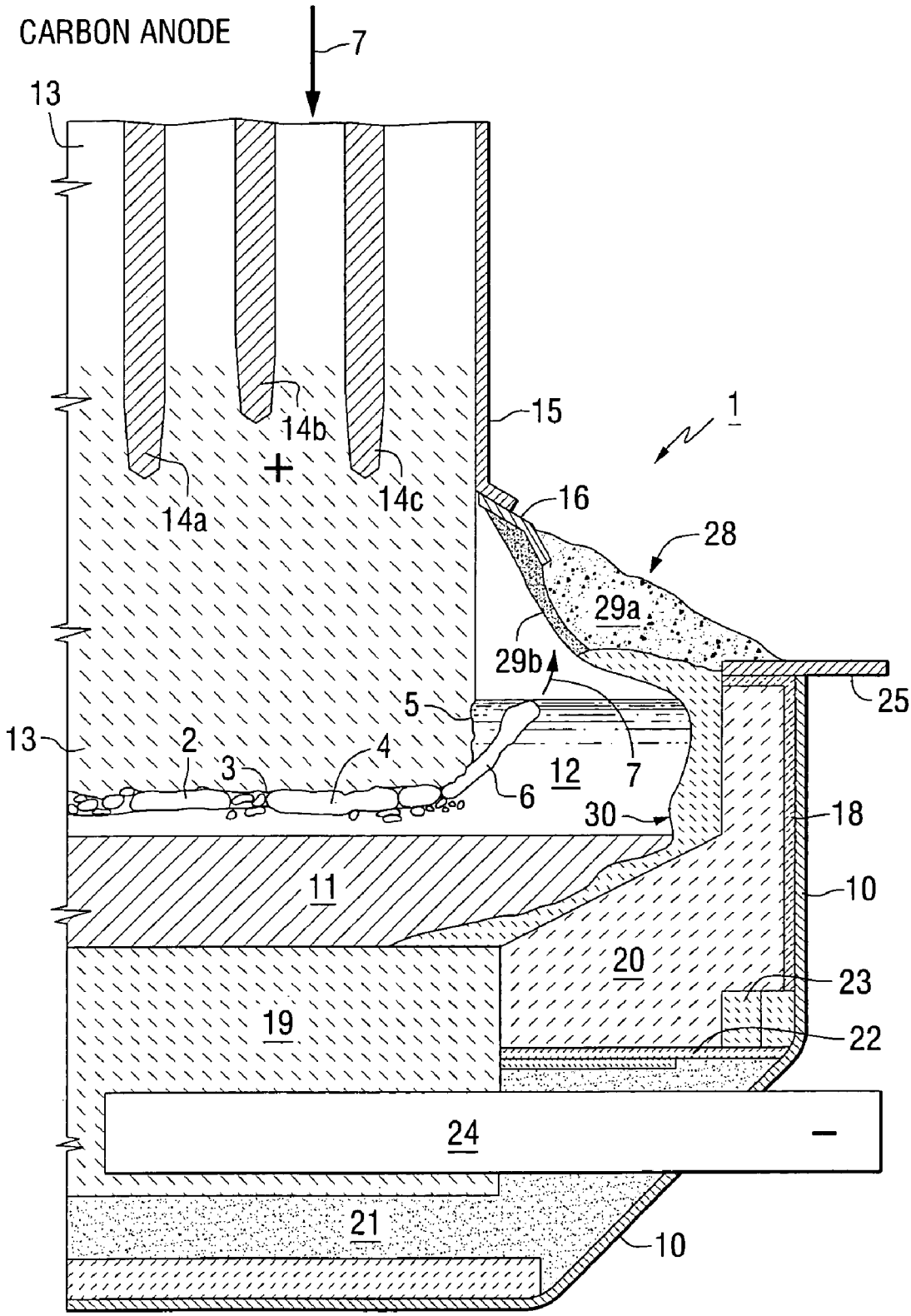
FIG. 1 PRIOR ART
FIG. 1, is a cross-sectional broken away view of one type prior art, traditional, self-baking Soderberg anode type cell similar to that illustrated in U.S. Pat. No. 3,996,117.

Referring now to FIG. 1 which illustrates one type of traditional self-baking Soderberg type carbon based anode 13 operating in molten electrolyte 12 in an aluminum electrolysis cell 1. This cell includes a steel shell 10, a product molten aluminum metal pool 11 and an electrolyte bath 12. Anode gas (primarily $CO_2$) bubbles appear as large trapped bubbles 2, at the bottom 3 of anode 13, coalescing into larger bubbles 4 near the side 5 of anode 13 and finally releasing as big bubbles 6, traveling upward as shown by the arrow 7'. Suspended in bath 12 is a positive (+) Soderberg anode 13. Associated with the Soderberg anode are metal, usually steel spikes/conductors/pins 14*a*, 14*b* and 14*c*, which are connected to the positive side of a source of electrical current. A metal, usually steel jacket 15 is provided on the upper sides of the anode, where the anode constituents have not yet hardened sufficiently (unbaked) to render themselves self-supporting. As the anode is consumed, as shown by the irregular bottom 3, it is moved downward into the electrolyte as shown by dark top arrow 7.

Surrounding the anode a manifold 16 can be used to provide an upper side for the porous crust 28 and to promote fume collection usually through a conventional exhaust burner (not shown). The pool (or pad) 11 of molten aluminum is supported on carbonaceous block lining 19 and carbonaceous tamped lining 20. The carbonaceous linings can be supported on an alumina fill 21. Optionally, there can be interposed between the tamped lining and the fill some quarry tile 22. A layer of red brick 23 can be situated next to the quarry tile 22. A mica mat 18 can be used for the purpose of providing an extra degree of safety against current flow through shell 10.

The cathode current is supplied through steel bars, 24, to the block lining 19. The current supply is indicated by plus and minus signs on the anode 13 and on connector bar 24 respectively.

A plate 25, provided on the upper edge of steel shell 10 can serve the purpose of protecting carbonaceous lining when the crust 28 is being broken for the purpose of feeding additional alumina to the bath 12. The crust 28 is formed of loose particles 29*a* of alumina. On its lower side, the crust becomes, in part, a sintered alumina-rich material 29*b*. Operating parameters are selected such that a frozen layer 30 of alumina and bath bounds the sides of the aluminum metal pad 11 and bath 12. It is preferred that layer 30 extend at least down to the bottom of the slope of tamped lining 20.

As shown in this prior art, Soderberg anode 13, both bottom 3 and side 5 are flat, and bubbles 2 and 4 are essentially trapped below the anode side between positive and negative poles in a semi-continuous bubble layer. In order to facilitate the release of these bubbles, the Soderberg anode shown in FIGS. 2-5 was developed.

As shown in FIGS. 2-5, this new and improved self-baking Soderberg type carbon based anode 40 has top 42, bottom 44 and side 46 surfaces, the bottom surface 44 contacting and being immersed in molten electrolyte 12, usually a molten cryolite electrolyte based on $Na_3AlF_6$ ($NaF+AlF_3$), which will operate at a temperature from about 800° C. to about 1100° C., usually from 900° C. to 1000° C. (m.p. aluminum being about 659° C.). A produced aluminum pool (or pad) 11 is formed beneath the molten electrolyte 12, the aluminum also acting as cathode. The cathode connector bar is shown as 24 and metal anode conductors as 14. The Soderberg anode 40 can be made from either dry or wet paste which typically comprises 20 wt. % to 30 wt. % coal tar/petroleum pitch and 70 wt. % to 80 wt. % calcined petroleum coke.

Figure 2:
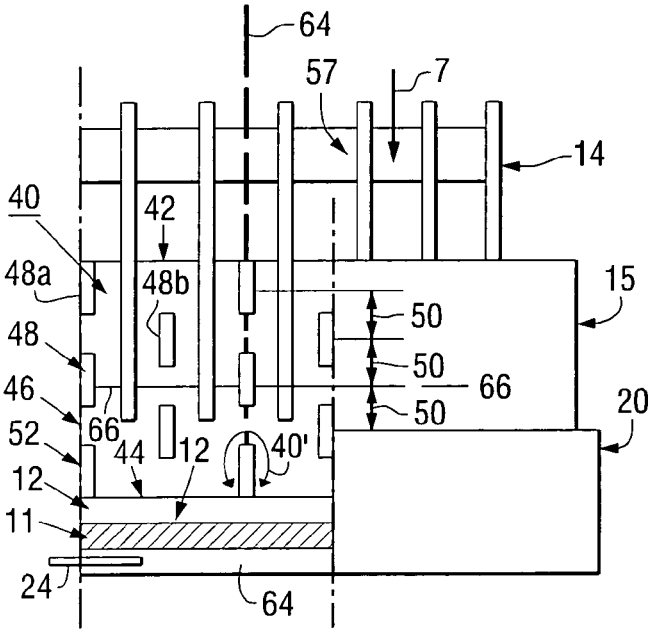
FIG. 2, is a schematic broken away view partly in section, front view, of part of a self-baking Soderberg anode type cell of this invention, showing a plurality of slots and embedded aluminum plate inserts within the anode.
Figure 3:
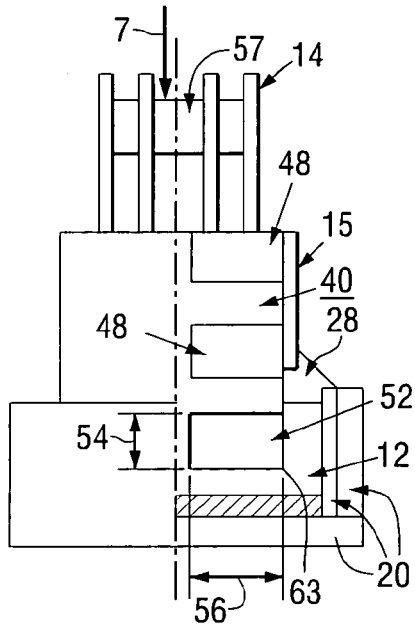
FIG. 3, is a schematic broken away view partly in section, side view, of the cell shown in FIG. 2.
Figure 4:
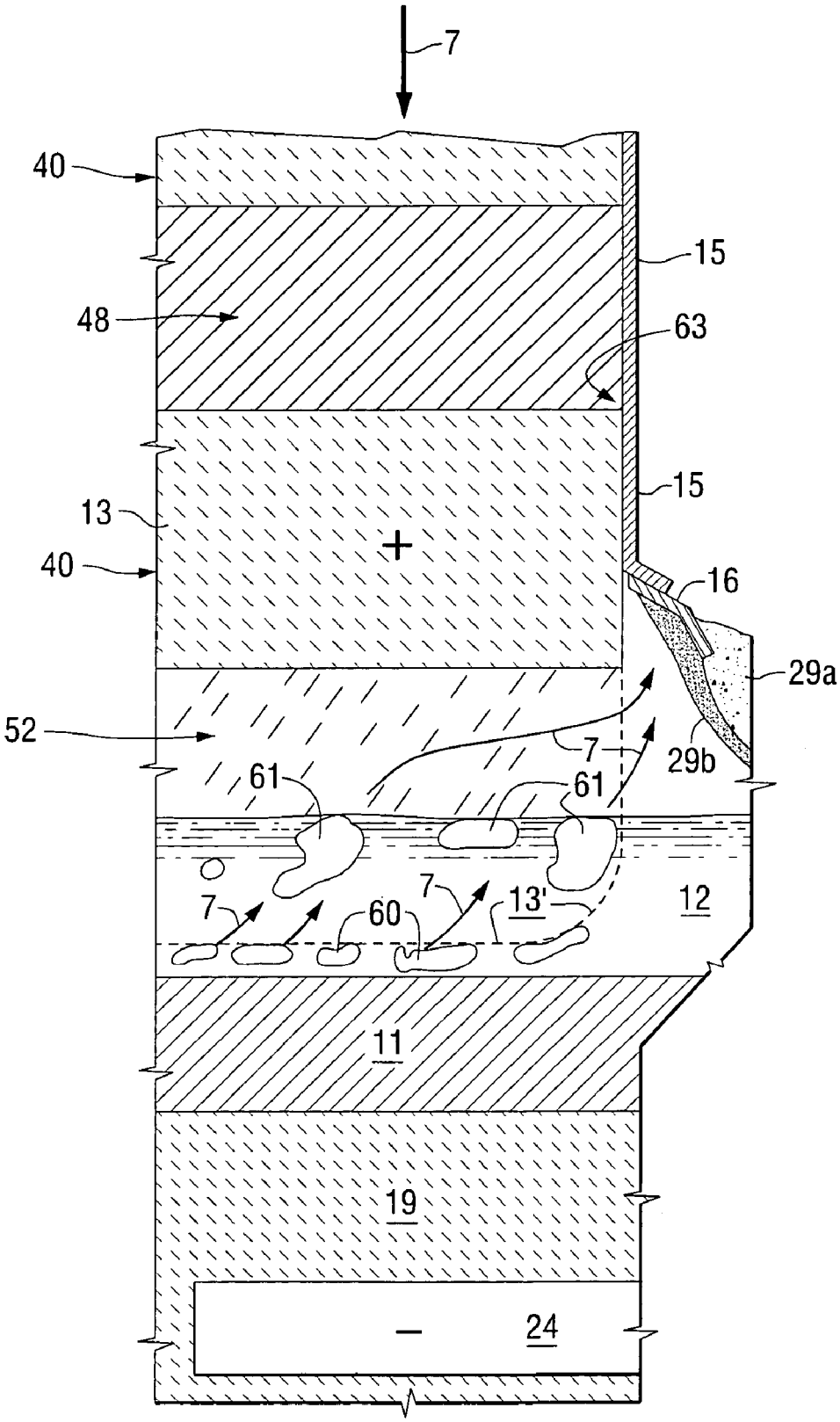
FIG. 4, which best illustrates the invention, is an enlarged partial view of the operating portion of FIG. 3 showing the anode in transition, in an aluminum electrolysis cell, where a slot is formed after an aluminum plate insert is melted, and where the surrounding carbon anode, shown as a dotted line, is producing bubbles and these bubbles flow into the slot, for ease of bubble removal.

As shown in FIGS. 2-4, meltable aluminum (also meant to include low Fe, Ni, Cu, Zn and Co impurity aluminum alloys) sheets, plates, or inserts, hereinafter "aluminum plate inserts" or "plate inserts" 48 are disposed within the anode 40 as layers or rows along horizontal axis, such as 66, on at least three different mid-plate insert to mid-plate insert vertical levels 50. These aluminum plate inserts are capable of melting as the bottom 44 of the anode 40 bakes in the molten cryolite 12, to create outward vertical, hollow slots 52, shown here in idealized form as completely melted, best shown in the side view of FIGS. 3 and 4, at the bottom of the anode. This would allow the usual $CO_2$ gas generated during operation of the electrolysis cell to easily channel through the open slots 52 to the side of the anode, as shown in FIG. 4.

While the discussion following will be directed to the preferred aluminum plate inserts, it is to be understood that several other solidified/fused/molded plate like materials are also useful provided they do not insert constituents detrimental to the purity of the aluminum that is being produced. Those other materials consist essentially of aluminum oxide, one or more of $Al_2O_3$; $Al_2O_3.H_2O$; $Al_2O_3.2H_2O$ and $Al_2O_3.3H_2O$), which is usually added periodically to the molten bath anyway, and cryolite (based on $Na_3AlF_6$) which is already in the molten bath. Of all these materials, aluminum would be the easiest to insert. Cryolite is meant throughout to include $Na_3AlF_6$, $AlF_3$ and other additives.

Also shown in FIGS. 2-5 are metal anode conductors, such as steel, spikes/stubs/pins 14 (hereinafter "pins"); metal, such as steel, anode casing/jacket 15. Also shown is lining 20, the bottom portion of which may have a connector bar 24. The slots 52 and inserts 48 can have a height 54 of from about 6 cm to 50 cm preferably 13 cm to 20 cm. Under 6 cm, inserts have to be made at the top of the anode, which would increase labor cost. Over 50 cm, there could be possible bleed through of paste if cryolite is used; also, anode integrity would be at risk. The length 56 of the plate inserts and slots ranges from about 50 cm to about 120 cm, depending on the length of the anode side. Under 50 cm, the majority of the anode surface cannot be covered by the slots, and therefore, not as effective. The width (thickness) is between 0.75 cm and 1.5 cm. Anode beam 57 for raising or lowering the anodes is also shown in FIGS. 2-3. Slot bottom edge is shown as 63 and the slot's surrounding anode is shown as 40'.

Referring to FIG. 4, for a clearer picture of cell operation, an enlarged partial view of the side view of FIG. 3 is shown. In FIG. 4, the anode 40 has moved downward and completely melts the bottom layer aluminum plate insert providing slot 52 by heat from the molten electrolyte which has a temperature higher than the melting point of aluminum. The melted aluminum falls to the metal pad, and left behind is a rectangular slot, such as 52 in FIG. 4. This slot 52 channels gas bubbles 60 out of the local anode surface, shown by dotted lines 13'.

The plate inserts are surrounded by the anode except when plate inserts interface with molten electrolyte 12 so the anode continues to react with the molten electrolyte, generating bubbles 60 and being consumed. The bubbles 60 will flow into slots 52 left after the aluminum is melted. Generally there is coalescing into large agglomerations of bubbles. Larger bubbles will further coalesce into giant blanket type of bubbles 61. The arrows 7' show the upward path of the bubbles. In both FIGS. 1 and 4, when the bubbles exit the electrolyte 12, they become part of the gaseous atmosphere above the electrolyte. Also shown are optional manifold 16 and the crust of loose particles 29*a* of alumina and sintered alumina-rich material 29*b*.

Figure 5:
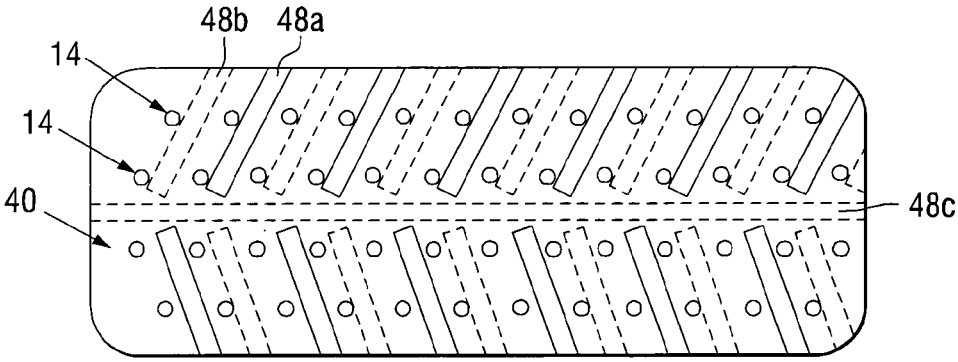
FIG. 5, is a schematic cross-sectional view top view of a self-baking Soderberg anode showing one positioning of the aluminum plate inserts at two vertical levels of the anode.

The carbonaceous block lining 19 contains connector bars 24. The metal pins are not shown in FIG. 4 for sake of simplicity. The aluminum plate inserts 48 are interdispersed throughout the anode body 40 in no necessarily particular arrangement, but preferably, at four layers or more in vertical columns 64, one beneath the other, and aligned in between pins 14, as best shown in FIG. 2. The aluminum plate inserts 48 are disposed between the metal pins 14 as shown in FIG. 2. As shown in FIG. 5, the metal pins can be offset at an angle as shown, where, in that situation, the plate inserts will also be offset and generally parallel to the metal pins. In FIG. 5, the set of plate inserts 48*a*, correspond to top plate insert 48*a* in FIG. 2, whereas the plate insert shown in dotted form 48*b* corresponds to the plate insert 48*b* in the next column and layer, one layer down in FIG. 2. End to end plate insert 48*c* can also be used and can be attached to or separate from the other inserts. The plate inserts must be all aluminum or a "low impurity aluminum alloy" having less than (<): about 0.1 wt % Fe, about 0.02 wt % Ni; about 0.05 wt % Cu; about 0.02 wt % Zn and about 0.02 wt % Co, so that when the alloy melts, the amount of non-aluminum components in the product melt will be commercially acceptable. Alternately, the plate inserts can be molded or fused aluminum oxide (such as $Al_2O_3$) or molded or fused cryolite (based on $Na_3AlF_6$).

The vertical slots 52 can be formed and maintained in Soderberg anodes by periodically inserting solid plate inserts 48 of aluminum metal, aluminum oxide, cryolitic bath or combinations of these materials into the unbaked carbon anode paste or briquettes at the top of anodes. Aluminum plate is preferred because it will remain at solid state when the carbon paste is baking out between 300° C. to 600° C. As the anode is consumed, the plate inserts 48 will move down along with the whole anode mass. They will melt (leaving empty space and formation of slots 52 upon contact with electrolyte) and the metal will be recovered in the metal pad once the anode section (with plates) travels down into the bath. The aluminum metal plate will not contaminate aluminum metal quality. The slot forming plates will be inserted in a vertical position into the carbon anode paste at the top of the anodes between the steel anode pins 14.

FIGS. 2-4 show how aluminum plates are inserted from the top of the anode along with charging anode paste and vertical slots are created once aluminum metal leaks out into metal pool below after the anode section travels down and in contact with molten bath.

In addition to the top to bottom aluminum plate insert arrangement for making vertical slots in the Soderberg anodes, the specifics of the aluminum plate inserts (or slots dimension) including the number of plate inserts used each time of insert and sizes of the plate inserts are considered part of invention disclosure. Only the correct number of slots with proper width in the Soderberg anode can achieve the optimal benefit (greatest impact) in reducing the pot noise (increasing pot stability) and reducing anode gas bubble voltage drop.

The slot forming vertical plates are designed to be the appropriate dimension to achieve the desired slot dimension with respect to width, length and height. The width of plate inserts (therefore the slot width) is selected in a such way that they will allow continuously channeling out a significant quantity of anode gas in a proper gas flow velocity. And at the same time, slots will not be collapsed or plugged. The width of slots (thickness of plate inserts) will be from about 0.75 cm to 1.5 cm, preferably 1.0 cm to 1.3 cm. The length of plate inserts depends on the Soderberg anode width. The strength and integrity of the anode carbon are also taken into account. The plate insert height decides the slot depth which dictates the life span of each slot. The plate height is preferably between 6 cm to 50 cm, preferably 9 cm to 20 cm, which would produce slots lasting between 6 days to 14 days. The top most slot forming aluminum plates are positioned between the rows of steel anode stubs/pins/spikes. The formed slots are therefore located in the canter locations between two rows of anode stubs/spikes (not touching the stubs). To insure there will always be an equal number of slots available at any time of operation, the plates are inserted in between every other pin rows (alternated in inserting plates between adjacent rows of steel anode stubs).

Figure 9:
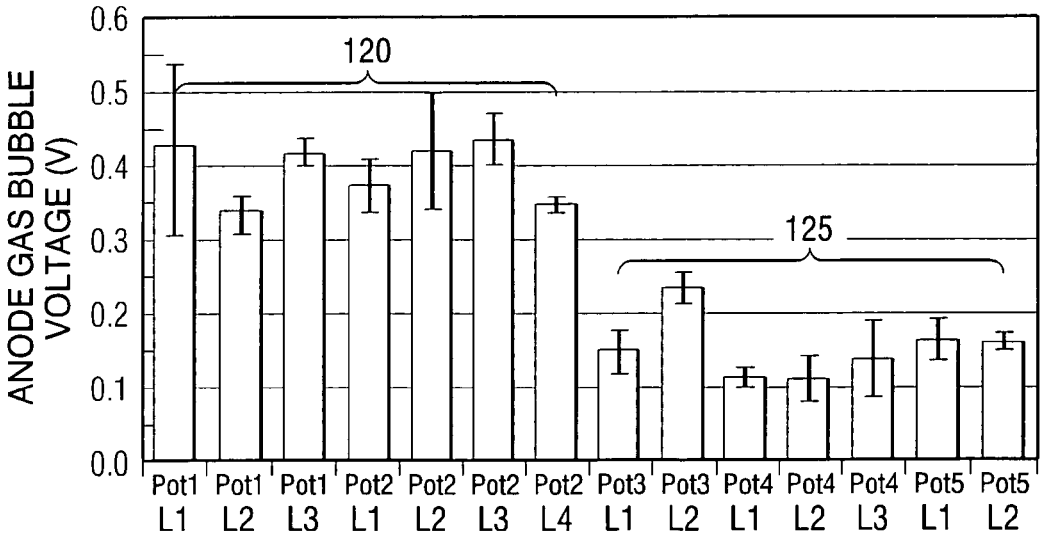
FIG. 9 is comparative graph of anode gas bubble voltage drop as measured on Soderberg anodes with and without slots.

Anode gas bubble voltage drop with and without slots in Soderberg anodes is demonstrated in FIG. 9, which is a comparison of anode gas bubble voltage drop as measured at different locations on Soderberg anodes with and without slots. The Soderberg anodes without slots are shown as voltages 120 and the Soderberg anodes with slots are shown as voltages 125. The gas bubble voltage drop on regular Soderberg anodes can be as high as 0.4 V. When slots are present in the surface, the gas bubble voltage drop can be reduced to as low as 0.15V, a difference as high as 0.25V. This is important because this is the potential of pot voltage saving by introducing slots in the Soderberg anode.

Figure 7A:
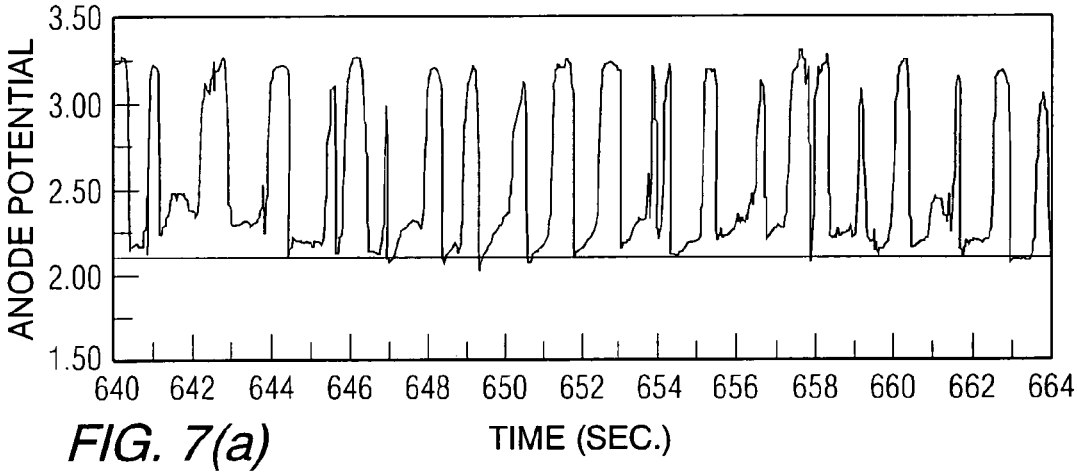
FIGS. 7(*a*) and 7(*b*) are comparative graphs of typical anode potential vs. time showing results of gas bubble size formation and release on anode surfaces of traditional Soderberg anodes and slotted Soderberg anodes.
Figure 7B:
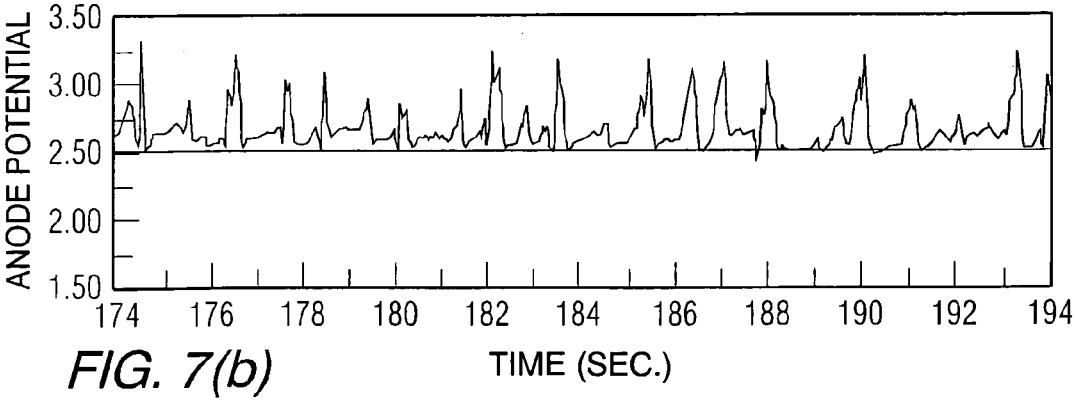

The presence of slots greatly reduces anode gas bubble size prior to the anode gas release/escape from the Soderberg anode surface. Shown in FIG. 7(*a*) is an anode potential (in reference to an Al metal electrode) responding to repetitive processes of Soderberg anode gas bubble formation→coalesce→release from the anode surface where there are no slots. Each peak and valley in the spectrum represents a cycle of gas bubbles from formation to release. The magnitude of the voltage potential fluctuation as well as the time taken to accomplish the cycle determine the size of the anode gas formation prior to its release. When slots are present in the Soderberg anode surface, the anode gas bubble size as well as the gas bubble formation and release processes can be modified, and as seen from FIG. 7(*b*) the magnitude of the anode potential is substantially reduced. The greatly reduced anode gas bubble size (formation and release under a Soderberg anode) under the presence of numerous slots in the Soderberg anode surface translates into reduced bubble voltage drop and a much more stable pot with reduced noise.

Figure 8A:
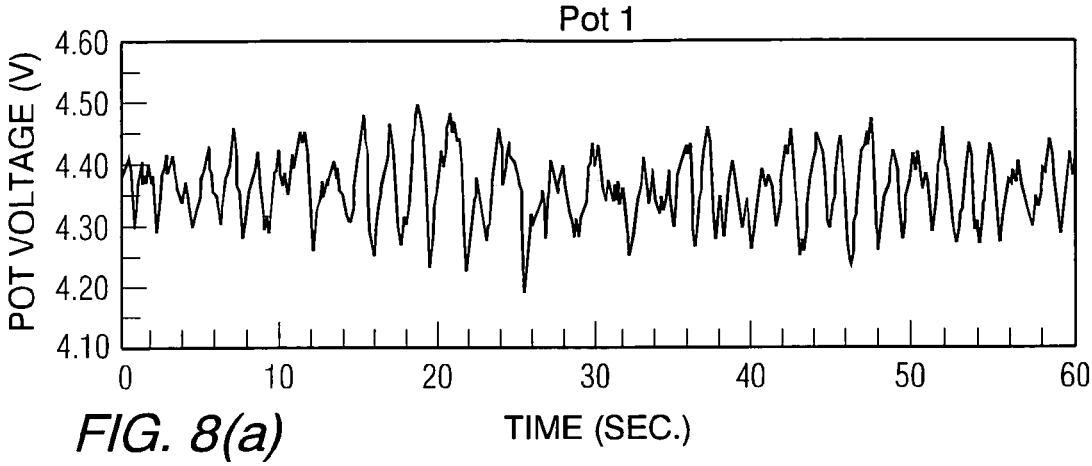
FIGS. 8(*a*) and 8(*b*) are comparative graphs of pot cell voltage (v) vs. time showing voltage fluctuation of a traditional Soderberg anode cell and a slotted Soderberg anode cell.
Figure 8B:
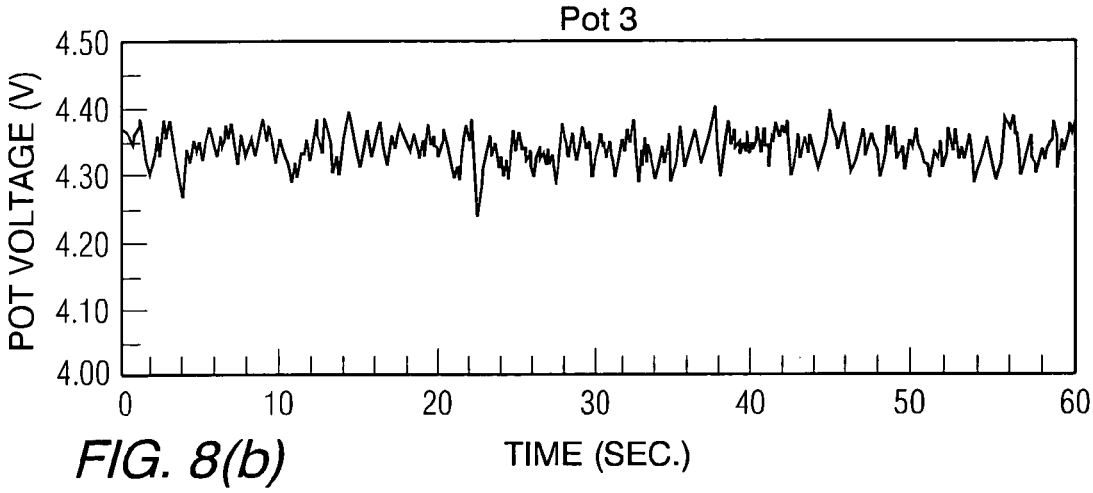

Pot voltage fluctuations on Soderberg anode with and without slots are shown in FIGS. 8(*b*) and 8(*a*) respectively. The magnitude of anode gas bubble size also translates the pot stability (noise). Shown in FIG. 8(*a*), the typical pot voltage fluctuations are recorded on a traditional Soderberg pot. The pot voltage fluctuates from a low of 4.2V to a high of 4.5V, as influenced primarily by anode gas bubble formation and release processes. The magnitude of the cell voltage fluctuation can be significantly reduced with the formation of slots in the Soderberg surface by disrupting the large gas bubble formation on the anode surface. FIG. 8(*b*) shows a cell voltage variation vs. time with a substantially reduced magnitude of fluctuation when slots are present. The cell voltage varies from a low of 4.3V to a high of 4.4V. FIG. 8(*b*) shows a cell voltage time recording having a much smaller voltage fluctuation as influenced by the slots to disrupt big gas bubble formation and release on the Soderberg anode surface.

Experimental Soderberg anodes containing vertically disposed plate inserts which melted in a hot cryolite bath at about 1000° C. were tested vs. traditionally unslotted Soderberg anodes for differences in bubble noise, defined as "short term" pot voltage peak to peak difference. The results indicated that "slotted" Soderberg cells have a greater potential for reducing gas bubble noise due to the higher noise associated with the large size of the single Soderberg anode.

Figure 6:
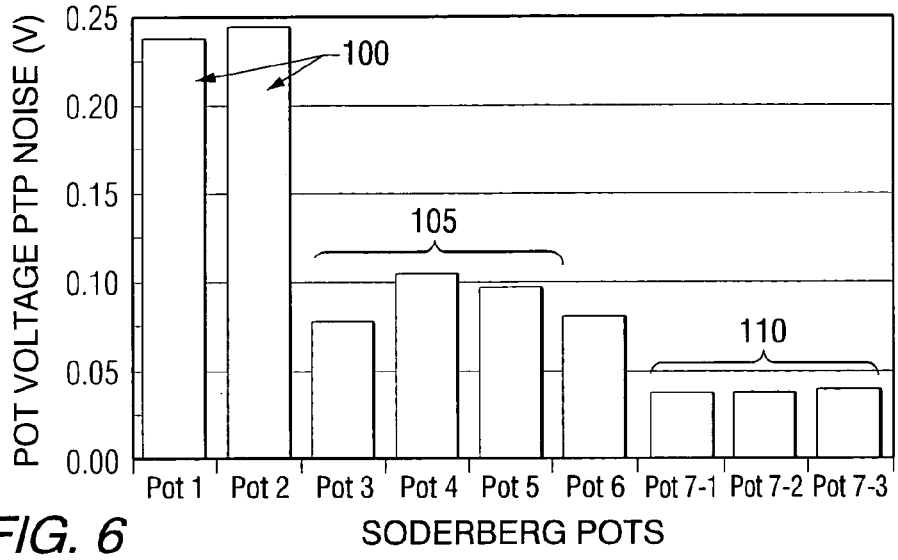
FIG. 6, is a comparative graph of anode pot voltage noise (V) of Soderberg cells, with traditional Soderberg anodes vs. slotted Solderberg anodes.

The pot noise was generally higher in the Soderberg pots with traditional anodes as shown in FIG. 6. The pot noise operating with anode slots was significantly reduced compared with pots with regular anodes, as shown in FIG. 6. Traditional Soderberg anodes with high noise are shown as 100, and traditional Soderberg anodes with low noise are shown as 105, while slotted Soderberg anodes are shown as 110. The pot noise was lowest in the Soderberg anode with slots 110, (0.04-0.05 volt). There was an 80% reduction in the pot noise when comparing with high noise traditional pots 100, (−0.200 volt.) There was a 40% reduction in pot noise when comparing with traditional low noise pots 105. This means on an average the slots can reduce the pot noise as high as 0.100 volts. Less pot noise also means better pot operation and high current efficiency.

Having described the presently preferred embodiments, it is to be understood that the invention may be otherwise embodied with the scope of the appended claims.

What is claimed is:

1. A self-baking Soderberg type carbon anode consumable in molten electrolyte, having top, bottom and side surfaces, wherein the carbon anode has at least four layers of vertically disposed plate inserts selected from the group consisting of aluminum, aluminum oxide, cryolite and mixtures thereof, meltable in molten cryolite electrolyte, said plate inserts capable of melting to create hollow slots at the bottom of the anode, allowing any gas bubbles generated upon operation of the anode to pass through the slots to the side of the anode.

2. The carbon anode of claim 1, wherein the plate inserts are aluminum.

3. The carbon anode of claim 1, wherein the plate inserts are low impurity aluminum alloy having "less than" about 0.1 wt % Fe; "less than" about 0.02 wt % Ni; "less than"

about 0.05 wt % Cu; "less than" about 0.02 wt % Zn and "less than" about 0.02 wt % Co.

4. The carbon anode of claim 1, wherein the plate inserts have a height of from about 6 cm to about 50 cm and a width of from about 0.75 cm to about 1.5 cm to allow continuous channeling of any gas bubbles formed, without plugging.

5. The carbon anode of claim 1, wherein the top most plate inserts are disposed between the conducting metal pins.

6. The carbon anode of claim 1 where the anode comprises coal tar and petroleum pitch.

7. The Soderbeg anode of claim 1, wherein the plates only extend partially through the anode.

8. An aluminum electrolysis cell comprising:

(1) at least one, consumable, self-baking Soderberg type carbon anode, having top, bottom and side surfaces with electrically conducting vertical metal pins disposed within the anode body;

(2) a molten electrolyte in which the at least one carbon anode is placed so the bottom surfaces of the anode contact the electrolyte to self-bake the bottom of the anode, and where gas bubbles are generated at the anode bottom surface;

(3) means to vertically move the at least one carbon anode in a downward direction into the molten electrolyte as the at least one carbon anode is consumed by the electrolyte; and (4) at least four layers of plate inserts selected from the group consisting of aluminum, aluminum oxide, cryolite and mixtures thereof within the at least one carbon anode, which inserts will melt with downward movement of the anode into the molten electrolyte to provide hollow slots communicating with the electrolyte, which slots can channel gas bubbles from the bottom of the at least one carbon anode into the electrolyte.

9. The electrolysis cell of claim 8, wherein the at least one carbon anode comprises coal tar and petroleum pitch.

10. The electrolysis cell of claim 8, wherein the molten electrolyte is a molten cryolite bath and the plate inserts are aluminum.

11. The electrolysis cell of claim 8, wherein the molten electrolyte is a molten cryolite bath and the plate inserts are low impurity aluminum alloy having "less than" about 0.1 wt % Fe; "less than" about 0.02 wt % Ni; "less than" about 0.05 wt % Cu; "less than" about 0.02 wt % Zn and "less than" about 0.02 wt % Co.

12. The electrolysis cell of claim 8, wherein the plate inserts have a height of from about 6 cm to about 50 cm and a width of from about 0.75 cm to about 1.5 cm to allow continuous channeling of any gas bubbles formed, without plugging.

13. The electrolysis cell of claim 8, wherein the top most plate inserts are disposed between the conducting metal pins.

14. The electrolysis cell of claim 8, wherein the plates only extend partially through the anode.

* * * * *